US005604574A

United States Patent [19]

Matsuura et al.

[11] Patent Number: 5,604,574

[45] Date of Patent: Feb. 18, 1997

[54] ELECTROPHOTOGRAPHIC IMAGE-FORMING METHOD

[75] Inventors: Katsumi Matsuura; Yuji Marukawa; Yoshihiko Etoh, all of Hachioji, Japan

[73] Assignee: Konica Corporation, Tokyo, Japan

[21] Appl. No.: 602,960

[22] Filed: Feb. 16, 1996

[51] Int. Cl.[6] ..... G03G 21/00

[52] U.S. Cl. ..... 399/350

[58] Field of Search ..... 355/296, 299; 430/106–107, 109

[56] References Cited

FOREIGN PATENT DOCUMENTS

| | | |
|---|---|---|
| 1105983 | 4/1989 | Japan . |
| 04069664 | 3/1993 | Japan . |
| 6118858 | 4/1994 | Japan . |

*Primary Examiner*—Nestor R. Ramirez
*Assistant Examiner*—Quana Grainger
*Attorney, Agent, or Firm*—Frishauf, Holtz, Goodman, Langer & Chick, P.C.

[57] ABSTRACT

An electrophotographic image-forming method is disclosed. The image forming method comprises the steps of (1) forming an electrostatic latent image on a rotating electrophotographic photoreceptor having an organic photoconductive layer, (2) developing the electrostatic latent image with a toner comprising toner particles which contain a releasing agent existing in the toner particle in a form of insular domain having a number average diameter of 0.1 μm to 1.1 μm to form a toner image, (3) transferring the toner image to an image receiving member, and (4) cleaning the surface of the photoreceptor after the transferring step by a cleaning member having a rubber elastic cleaning blade having an impact resilience of 35 to 75% which is contacted to the surface of the photoreceptor in the direction counter to the rotating direction of the photoreceptor with a pressure of 5 to 40 g/cm, and the coefficient of static friction between the cleaning blade and the surface of the photoreceptor is not more than 1.0.

3 Claims, 2 Drawing Sheets

ELECTROPHOTOGRAPHIC IMAGE-FORMING METHOD

FIELD OF THE INVENTION

The present invention relates to an electrophotographic image-forming method using an organic photoconductive photoreceptor, hereinafter simply referred to photoreceptor, in which sufficient cleaning of the photoreceptor can be attained.

BACKGROUND OF THE INVENTION

In a usual image-forming method using an electrophotographic photoreceptor according to Carlson's method, an image is formed by the procedure comprising the steps of uniformly charging the surface of a photoreceptor, image-wise exposing the surface to form an electrostatic latent image, developing the latent image by a developer containing a toner to form a toner image, transferring the toner image to an image receiving sheet, and fixing the toner image on the sheet.

On the other hand, the photoreceptor is subjected to cleaning process for removing toner remained on the surface, and is discharged for standing by the next image forming operation. Thus the photoreceptor is repeatedly used for a prolonged term.

Accordingly, the photoreceptor is required to be excellent in physical properties such as copying durability, resistivity to abrasion and resistivity to humidity, and in resistivity to ozone generated at the time of corona discharge and to UV ray at the time of light exposure as well as in electrophotographic properties such as electrification property, light-sensitivity and dark decay.

An inorganic photoreceptor using an inorganic photoconductive substance such as amorphous silicon or selenium as a main composition, is widely used. Recently, however, an organic photoreceptor using an organic photoconductive substance becomes to be used, which is low in cost, and excellent in workability, and has a wide selection degree of freedom according to use.

Although various cleaning methods has been known for cleaning the toner remaining on a photoreceptor, such as a magnetic brush method and a fur brush method, a rubber elastic cleaning blade is principally used since which is simple in the constitution and is excellent in the cleaning effect. As the form to contact the rubber elastic cleaning blade to the photoreceptor, trailing method and counter method has been known. Among them, the counter method is mainly used in the reason of that this method is superior in the cleaning effect. In the counter method., the blade is contacted to a photoreceptor so as to make an acute angle against to the moving direction of the photoreceptor as shown in FIG. 2.

For developing an electrostatic latent image formed on the photoreceptor, a single-component developer mainly composed of magnetic toner particles having a size of 1 to 30 μm, or a two-component developer composed of non-magnetic toner particles having a size similar to that of the magnetic toner particles and magnetic carrier particles having a size of 10 to 100 μm are usually used. The toner particle comprises a binder resin, a colorant dispersed in the resin, and a releasing agent such as a low-molecular weight wax, the particle further contains a magnetic powder dispersed in the resin if it is necessary.

On the other hand, with respect to the organic photoreceptor, there are problems, since the surface of the organic photoreceptor is softer than that of an inorganic photoreceptor and the fine toner particles or an addendum thereof is tend to be tightly adhered on the surface of the photoreceptor. The adhered substances are difficult to remove. Further the surface of the organic photoreceptor is tend to be worn away and the electrophotographic properties of the photoreceptor is degraded when the photoreceptor is subjected to cleaning operation, with a strong pressure the same as for the inorganic photoreceptor.

Japanese Patent Publication Open for Public Inspection (JP O.P.I.) No. 6-130711/1994 (Publication 1) proposes a countermeasure to the above problems, in which a photoreceptor having a protective layer on an organic photoconductive layer is used. The protective layer contains 5.0 to 70.0% by weight of fine particles of a fluororesin, and has a surface roughness of 0.1 to 5.0 μm, a surface hardness by Teber method of 0.1 to 20.0, and a surface friction coefficient of 0.001 to 1.2. The photorecepter is subjected to cleaning by a rubber-elastic blade which is contacted to the photoreceptor with a line pressure of 20.0 to 50.0 g/cm. The publication describes that the wearing off and the defect formation on the surface of the photoreceptor, and insufficient cleaning caused by turning over the cleaning blade are prevented by the above technique. As result of that, the durability of the photoreceptor can be raised, and an excellent image can be obtained.

Further, for example, JP O.P.I. Nos. 3-264961/1991 (Publication 2) and 2-296067/1991 (Publication 3) describe that the releasing agent contained in the toner of the developer strongly relates to the cleaning condition of the photoreceptor. The above Publications 2 and 3 each describes that the formation of finely crushed toner and filming of toner can be prevented when the domain size of the releasing agent is not more than 5000 Å and 2000 Å to 3000 Å, respectively.

A comprehensive study on the properties of surface of photoreceptor, cleaning member and toner for developer are indispensable to solve the problems of cleaning of remaining toner on the photoreceptor surface. It is considered that the sufficient cleaning would be attained after these properties have been made clear. However, in the disclosure of the above Publication 1, technical attention is devoted only to the roughness, hardness and friction coefficient of the photoreceptor surface, and property of the cleaning blade and that of the toner are not described at all.

As above-mentioned, the techniques of Publications 2 and 3 are attained by paying attention to the releasing agent in the characteristics of the toner. In the publications, it is described that formation of finely crushed toner can be prevented when the maximum domain size of releasing agent existing in the resin in an insular form, is not more than 5000 Å, particularly within the range of 2000 to 3000 Å. The finely powdered toner is tightly adhered to the surface of photoreceptor and the adhered toner is difficult to removed. As a result, the filming of on the photoreceptor caused by fine powdered toner and degradation in the electrophotographic property of the photoreceptor by fatigue can be prevented.

However, it has been found by the inventors, that the cause of filming of a foreign substance on the photoreceptor is changed depending on the kind of photoreceptor and composition of the toner to be used. Particularly, in the process using the organic photoreceptor, the filming is mainly caused by adhering the releasing agent broken away from the toner rather than adhesion of the finely crushed toner.

Namely, the releasing agent domain contained in the toner is broken away from the toner and adheres on the photoreceptor surface in a form of film in the course of image forming by the organic photoreceptor. The film formed on the photoreceptor degrades the cleaning effect of the cleaning blade and causes adhering powder of metal or paper, addition to the toner, on the photoreceptor surface. The adhesion of such foreign substances causes degradation in the electrophotographic property of the photoreceptor and formation of image defects such as white spots, black spots and black streaks.

SUMMARY OF THE INVENTION

The object of the invention is to provide an image-forming method and all image-forming apparatus avoiding insufficient cleaning caused by turning off of the cleaning blade, damage and abrasion at the surface of photoreceptor and degradation in electrophotographic properties of the photoreceptor and formation of image defects such as black and white spots and black streaks.

The object of the invention can be attained by an electrophotographic image-forming method comprising the steps of (1) forming an electrostatic latent image on a rotating electrophotographic photoreceptor having an organic photoconductive layer, (2) developing the electrostatic latent image with a toner comprising toner particles which contain a releasing agent existing in the toner particle in a form of insular domain having a number average diameter of 0.1 μm to 1.1 μm to form a toner image, (3) transferring the toner image to an image receiving member, and (4) cleaning the surface of the photoreceptor after the transferring step by a cleaning member having a rubber-elastic cleaning blade having an impact resilience of 35 to 75% which is contacted to the surface of the photoreceptor in the direction counter to the rotating direction of the photoreceptor with a pressure of 5 to 40 g/cm, and the coefficient of static friction between the cleaning blade and the surface of the photoreceptor is not more than 1.0.

DETAILED DESCRIPTION OF THE INVENTION

Figure 1:
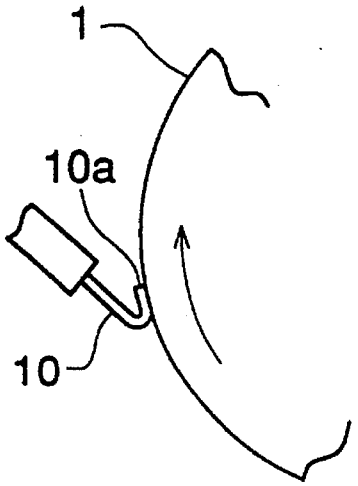
FIG. 1 PRIOR ART
FIG. 1 shows a situation of turning over of cleaning blade.

In a preferable embodiment of the invention, the above-mentioned cleaning blade is composed of urethane rubber and the coefficient of friction between the surface layer of the photoreceptor and blade cleaning member is 0.01 to 1.0.

Although the photoreceptor may be one having single photoconductive layer containing both of a carrier generation material (CGM) and a carrier transportation material (CTM), a multilayered photoreceptor is preferred, which have two layers separated according to the functions thereof, i.e., a carrier generation layer (CGL) mainly composed of the CGM and a carrier transportation layer (CTL) mainly composed of the CTM.

In the present invention, the multilayered photoreceptor is prepared by the procedure in which a CGL composed of a binder resin and a CGM dispersed in the binder is provided on a substrate by coating, and a CTL composed of a binder resin, a CTL dissolved or dispersed in the binder and preferably organic fine particles dispersed in the binder is further provided on the CGL. The substrate may have an interlayer in advance if necessary.

As the CGM to be contained in the CGL, for example, a phthalocyanine pigment, a polycyclic quinone pigment, an azo pigment, a perylene pigment, an indigo pigment, a quinacridone pigment, an azulenium salt dye, squalilium dye, a cyanine dye, a pyrilium dye, thiopyrilium dye, xanthene dye, quinoneimine dye, a triphenylamine dye and a styryl dye can be described.

As the CTM to be contained in the CTL, for example, a pyrene compound, an N-alkylcarbazole compound, a hydrazone compound, an N,N-dialkylaniline compound, a diphenylamine compound, triphenylamine compound, a triphenylmethane compound, a pyrazoline compound, a styryl compound, a stilbene compound, a polynitro compound and a polycyano compound, and a pendant polymer composed of a polymer and one of the above compound fixed thereon can be described.

As the binder of CGL, for example, a polyester, a polyurethane, a polyacrylate, a polyethylene, a polystyrene, a polybutadiene, a polycarbonate, a polyamide, a polypropylene, a polyimide, a phenol resin, an acryl resin, a silicone resin, an epoxy resin, a urea resin, an allyl resin, an alkyd resin, a polyamide-polyimide resin, a nylon resin, a polysulfon resin, a polyallylether resin, a polyacetal resin and butyral resin can be described.

The binder resin to be used for CTL is required to have a high resistivity against a mechanical impact, an excellent anti-wearing property and an appropriate coefficient of friction to the cleaning blade since the CTL is to be the outermost surface of the photoreceptor.

The binder resin of CTL can be selected from the above-mentioned binder resins for CGL, and the following polycarbonate resin having a weight average molecular weight of not less than 50,000 (B-1 to B-3), particularly one having a group with releasing ability such as a silicon- or fluorine-containing group (exemplified compound B-4), is preferred.

B-1

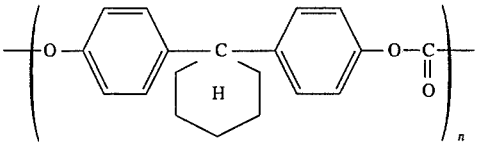

weight average molecular weight: 100,000

-continued

B-2

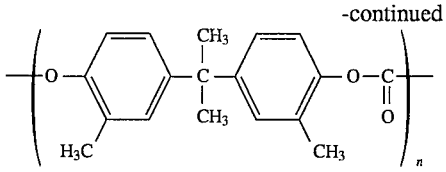

weight average molecular weight: 98,000

B-3

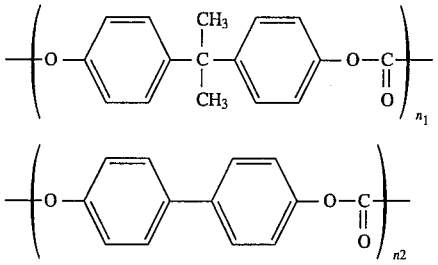

weight average molecular weight: 105,000
copolymerization ratio, $n_1:n_2$ = 80:20

B-4

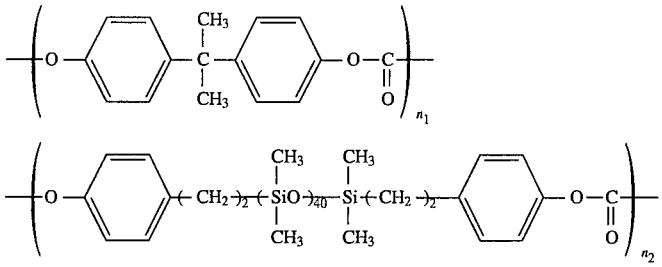

weight average molecular weight: 120,000
copolymerization ratio, $n_1:n_2$ = 95:5

The thickness of the CGL is 0.001 to 6 μm, preferably 0.01 to 2 μm, and the content of the CGM in the CGL is 10 to 100% by weight, preferably 50 to 100% by weight of the total weight of the CGL.

The thickness of the CTL is 5 to 40 μm, preferably 15 to 30 μm, and the content of the CTM in the CTL is 20 to 80% by weight, preferably 30 to 70% by weight of the total weight of the CTL.

As the electroconductive substrate, the followings are usable:

1) a metal plate such as an aluminum plate of a stainless steel plate, 2) one composed of a thin layer of metal such as aluminum, palladium or gold provided on a support such as a paper or a plastic film by lamination or evaporating deposition, and 3) one composed of a layer of a conductive substance such as a conductive polymer, indium oxide or tin oxide provided on a support such as a plastic film or a paper by coating or evaporating deposition.

The interlayer provided on the substrate according to necessity, which functions as an adhering layer or a blocking layer, can be composed of, for example, a polyvinyl alcohol, an ethyl cellulose, a carboxymethyl cellulose, copolymer, a vinyl chloride/vinyl acetate/maleic anhydride copolymer, casein, and an alcohol-soluble nylon or starch, as well as the resin usable in the CGL or the CTL.

It is essential that the surface of the photoreceptor of the invention has a coefficient of static friction of 0.01 to 1.0 with respect to the cleaning blade.

When the coefficient of static friction is less than 0.01, the toner remaining on the surface of the photoreceptor cannot be completely removed since the cleaning blade contacted to the surface is slipped and the sufficient cleaning for practical use cannot be not attained. When the coefficient of friction exceeds 1.0, the wearing and damage of the photoreceptor is raised and the cleaning blade is turned over as shown by 10*a* in FIG. 1.

FIG. 1 shows a situation of turning over of the cleaning blade. In the figure, cleaning blade 10 is contacted to organic photoreceptor drum 1 in the direction counter to the rotation direction of the drum, and the from edge of the blade 10*a* is crooked and turned over. Such phenomenon is referred to as "turning over of blade".

Formation of such turning over of the blade causes a serious damage on the surface of photoreceptor and the photoreceptor become a state necessary to be exchange.

It has been found by the inventors that the "turning over" of the cleaning blade is caused a strong static friction force generated between the surface of photoreceptor and the front edge of the blade at the starting period of image forming operation. At the starting period, the rotation speed of photoreceptor is rapidly accelerated to the prescribed speed and the strong friction force is generated. Therefore, the turning over of blade is closely related to the coefficient of static friction of the photoreceptor surface with respect to the cleaning blade.

The coefficient of static friction can be measured by a surface property measuring apparatus HEIDON-14, manufactured by HEIDON Co., when the photoreceptor is in a form of sheet, plate or endless belt.

However, the photoreceptor usually to be installed in an electrophotographic image-forming apparatus for practical use is in a drum form. In this case, the coefficient of static friction μ can be determined by measuring the rotating torque T (kg, cm) of the photoreceptor drum.

The coefficient of static friction can be calculated form the following equation. In the equation, $T_1$ (kg/cm) is rotating torque of a photoreceptor drum itself and $T_2$ is rotating torque of the photoreceptor drum when a cleaning blade is contacted to the photoreceptor with a loading weight of F (kg), and γ is the radius (cm) of the drum.

$$\text{Coefficient of static friction } \mu=(T_2-T_1)/(F\times\gamma)$$

There are some ways for making the coefficient of static friction of the photoreceptor to a value required in the invention, not more than 1.0. One of the effective methods for controlling the static coefficient is selection of binder resin of the outermost layer. A binder resin having a small friction coefficient such as a high molecular silicone resin or fluoro-resin is preferably used as a binder resin of the outermost layer for decreasing the friction coefficient of the surface of the photoreceptor. Another method for controlling the friction coefficient is addition of spherical organic particles in the outermost layer for decreasing the friction coefficient of the surface of the photoreceptor. Spherical particles of silicone resin or a fluoro-resin are preferably used for this purpose. Various kinds of particles of silicone resin, for example, various kinds of Tospal manufactured by Toshiba Silicone Co., are aveilable in the market. The friction coefficient can be adjusted by selection of the kind of the particle and controlling the amount thereof. The preferable average size of the organic fine particles is within the range of from 0.05 to 5.0 μm, and the particles are contained in the outermost layer in a dispersed state or aggregated state in an amount of 5 to 40% by weight of the total weight of the outermost layer.

As the cleaning blade to be used in the image-forming method of the invention, one made from polyurethane rubber is preferred. The cleaning blade made from polyurethane rubber can be made compact and light weight with low cost, and has a high anti-wearing property and an excellent cleaning ability.

Figure 2:
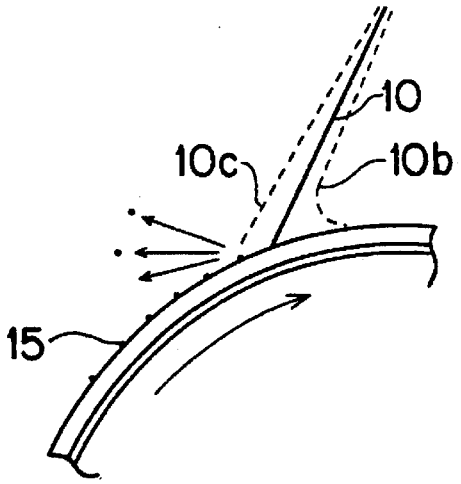
FIG. 2 shows a cross section of a cleaning device and an organic photoreceptor drum according to the invention.

Mechanism of cleaning the toner remaining on the photoreceptor drum by the above-mentioned cleaning blade is described based on FIG. 2.

FIG. 2 shows the cross section of a cleaning device and a photoreceptor drum in an embodiment of the invention.

As shown in FIG. 2, when cleaning blade 10 is contacted to the surface of organic photoreceptor drum 1 rotating to the direction of arrow, the front edge of the cleaning member 10 is bent, according to its viscoelasticity, as **10*b* by the friction force generated between the drum surface and the blade. The bending of the blade raises the contact area and friction force. As a result of that, the bending of the blade is attained to a critical limit. Then the cleaning member spring backs to the position 10*c* by the impact resilience thereof and scrapes off the remaining toner 15** from the surface of the organic photoreceptor drum.

As is obvious from the above-mentioned mechanism of cleaning, the impact resilience of the cleaning blade 10 is an important factor of the cleaning property of the cleaning blade. In the present invention, the cleaning blade has to have a impact resilience of 35 to 75% measured by the method defined in JIS K7311. In JIS K7311, the impact resilience is measured as follows:

A piece of sample having a size of 20–30 mm×20–30 mm and a thickness of 10–15 mm is set under an iron rod vertically hung with a string so that the distance between the lowere end of the rod and the surface of the sample to be 100 mm. The length, diameter and weight of the iron rod are 356 mm, 12.7 mm and 530 g, respectively, and the lower end of the rod is shaped in a hemishere form having a diameter of 12.7 mm. Then the rod is fallen to the sample and the rebounded height of the rod is measured. The impact resilience is determined by the percentage of the rebounded hight to the fallen height of the rod.

When the impact resilience is less than 35%, the cleaning blade tend to turn over which causes a damage on the photoreceptor surface and insufficient cleaning, even if the coefficient of static friction is lowered to 1.0 or less.

When the impact resilience exceeds 75%, the impact resilience too strong causes wearing off and damage of the photoreceptor surface and degrades the electrophotographic property of photoreceptor.

In the cleaning process using the above-mentioned cleaning blade, a range of the lording weight to be applied to the cleaning blade contacted to the photoreceptor is usually decided empirically. However, in the present invention, the loading weight has to be within the range of 5 to 40 g/cm in terms of line pressure because the organic photoreceptor and the elastic cleaning blade made from urethane rubber are used in the invention.

When the loading weight is less than 5 g/cm or less in terms of line pressure, the cleaning cannot be attained and when the loading weight is more than 40 g/cm, the surface of photoreceptor is tend to be worn off or damaged and the turning over of blade is also tend to be occurred.

The loading weight applied to the cleaning blade contacting to the photoreceptor is calculated by dividing a pressure giving to the blade by the length of the blade. The pressure is given, for example, by a spring or a weight. The cleaning blade 10 is contacted to the photoreceptor with an angle of 10° to 45° with respect to the tangential line at the contacting point in the counter direction. The thickness of the cleaning blade is preferably 0.5 to 10 mm.

Further to the above-mentioned conditions for cleaning the toner remaining on the organic photoreceptor drum, conditions of toner contained in a developer to be used in a magnetic brush development is an important factor dominating the result of cleaning.

In the magnetic brush development, a developer is carried on a sleeve which relatively rotates around a magnetic drum having a plurality of magnet poles, and transported into a developing region to develop an electrostatic latent image by a contacting or non-contacting developing method. In the developing device, a single-component developer mainly composed of magnetic toner or a two-component developer composed of a non-magnetic toner and a magnetic carrier is charged.

The toner particles in the developer comprises a binder and a colorant and a releasing agent. An electrification controlling agent and another addendum are contained in the particles according to necessity. Magnetic powder is further contained in the toner particles in the case of the magnetic toner. The average size of the toner particles is preferably 1 to 30 μm.

A styrene resin, acryl resin, vinyl resin and polyester resin are usable as the binder resin of the toner.

In the present invention, the releasing agent includes polyethylene, polypropylene, natural wax and sythetic wax each having a lower softening point, which inhibit off-set of toner at the time of transferring a toner image to an image receiving sheet. For example, a polyolefin wax such as a low molecular weight polypropylene, a low molecular weight polyethylene each having a softening point of 100° to 160° C. (measured by ring and ball method according to JIS K2531), a fatty acid ester wax, a higher fatty acid wax, a higher alcohol wax, a paraffin wax and a acid amide wax are usable as the releasing agent to be contained in the toner particles of the invention.

As the avobe-mentioned compounds having a lower softening point, for example, a polyolefin wax such as a low molecular weight polyethylene, a low molecular weight polypropylene and a low molecular weight ethylene/propylene copolymer each having a number average molecular weight of 1500 to 8000 in terms of that of polystyrene measured by a high temperature gel permeation chromatography, a high melting point wax such as micro wax or Fischer-Tropsch wax, an ester type wax such as a lower alcohol ester of fatty acid, a higher alcohol fatty acid ester, a polyvalent alcohol fatty acid ester, amide type wax, and a natural wax such as carnauba wax are usable.

As the colorant to be contained in the toner, various known ones are usable without any limitation. Carbon black, Nigrosine dye, Aniline Blue, Calcoil Blue, Chrome Yellow, Ultramaline Blue, Du Pont Oil Red, Quinoline Yellow, Methylene Blue Chloride, Phthalocyanine Blue, Malachite Green Oxalate and Lump Black and Rose Bengal are described for example.

The amount of the colorant is usually 0.1 to 20 parts by weight to 100 parts of the binder resin.

As an addendum other than the above, for example, an electrification controlling agent such as a derivative of salicylic acid is usable. Further, magnetic particles are added to the toner particle when a magnetic toner is prepared. For the above magnetic particles, those of ferrite or magnetite having an average size of 0.1 to 2 μm are usable. The adding amount of the magnetic particles generally 20 to 70% by weight of toner particle without external addendum such as a complex particle.

The toner may further externally incorporates inorganic fine particles such as hysriphobic silica particles or titanium oxide particles, and complex fine particles composed of organic particles and silica adhered thereon for raising the fluidity of the toner. As the inorganic particles, one hydrophobilized with a silane coupling agent or a titanium coupling agent.

As the above-mentioned releasing agent, one immiscible with the binder resin of the toner is preferred. The releasing agent is dispersed in the toner particle in a discontinuous insular state each occupying a domain. It has been known that the number average diameter of the insular domain influences the cleaning property of the photoreceptor. It has been confirmed that a specific image defect is formed when the number average diameter of the domain is too large or too small.

The number average diameter of the domain of the releasing agent can be controlled by changing the preparation conditions of the toner particles such as mixing, melting, kneading, crushing and classifying. Among them, changing in the conditions of melting and kneading are most effective for producing toner particles having a average diameter satisfying the requirement of the invention. The melting and kneading of the toner composition are preferably carried out within the temperature range of from the glass transition temperature Tg of the binder resin to the temperature of Tg plus 250° C. The domain diameter of the releasing agent is gradually increased accompanied with raising the melting and kneading temperature. The domain of the releasing agent is hardly formed at a temperature lower than Tg of the binder resin, and the binder resin is decomposed at a temperature higher than Tg plus 250° C., and properties of heat fixing and anti-offset of the toner are degraded. The diameter of the domain can be also controlled by changing in the rotating speed of the kneader or in the supplying rate of the composition to the kneader.

Therefore, in the present invention, it is required that the number average domain diameter of the releasing agent in the toner particle is 0.1 to 1.1 μm.

In an image-forming process using the above-mentioned organic photoreceptor, the releasing agent is considerably tend to release from the domain when the number average diameter of the domain exceeds 1.1 μm. The releasing agent released from the toner is transferred to the surface of the photoreceptor and causes formation of image defects such as black spots. When the number average diameter of the domain is smaller than 0.1 μm, the fixing and anti-offset properties of the toner is considerably lowered and stains are formed on the image.

The number average diameter of the domain is determined by the following method.

A toner particle is embedded in a resin and sliced by a microtome to make a slice of 0.2 μm. The sliced sample is photographed by a transmission electron microscope with a magnitude of 280 on the negative image. The negative image is enlarged so as to make the magnitude to 1200. The number average diameter of the domain in the sample is measured on thus obtained enlarged image by an image analyzer SPICCA manufactured by Nihon Avionics Co. Five hundreds of more domains are measured and the number average diameter, in terms of the diameter of circle, of them is determined.

The image-forming method and the apparatus using the above-mentioned organic photoreceptor, developer and blade cleaning member are described below based on FIG. 3.

Figure 3:
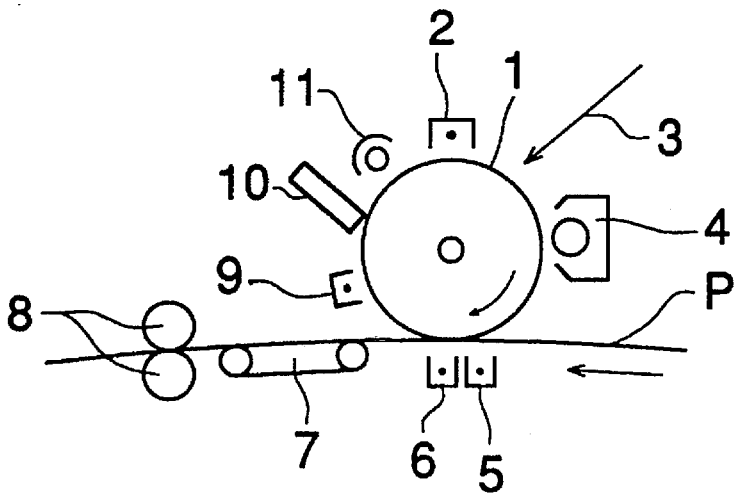
FIG. 3 is a cross section of an image forming apparatus according to the invention.

FIG. 3 shows a cross section of an image-forming apparatus of an embodiment of the invention.

In FIG. 3, 1 is an organic photoreceptor drum rotating in the direction of the arrow, 2 is a charger for uniformly charging the surface of the photoreceptor. The charger may be a corona charger, a roller charger or a magnet brush charger. The photoreceptor is imagewise exposed by a light beam 3 which has analogue or digital image information for forming an electrostatic latent image on the surface of the photoreceptor 1. A LED or LD is usually used as the light source for digital exposure. The latent image is developed to a toner image by a magnetic brush developing device 4 in which a single-component or two-component developer is charged and the development is carried out by contact or non-contact development. The toner charged in the developing device contains a releasing agent such as a low molecular weight polypropylene or a low molecular weight polyethylene each having a number average domain diameter of 0.1 to 1.1 μm, in an amount of 1 to 10 parts by weight of the binder of the toner for preventing the foregoing image defects.

The obtained toner image is transferred to an image receiving material P, which is transported synchronized with the moving of the photoreceptor drum, by corona discharge given from a discharge electrode 5, or a roller transfer device. Then the image receiving material P is separated from the photoreceptor by separation electrode and transported into a fixing device 8 by a transportation device 7 so that the toner image is thermally fixed on the image receiving material to form an visible image.

The surface of the photoreceptor is discharged by a discharger 9 after the transferring the toner image, and is cleaned by a blade cleaning member 10 contacted to the surface of the photoreceptor in the direction counter to the rotating direction of the photoreceptor. Then the surface of the photoreceptor is further discharged by a discharging lump 11 for standing by the next image forming operation.

In the present invention, the cleaning blade is made from a rubber elastic substance, preferably a urethane rubber, having a impact resilience of 35 to 75%. The cleaning blade is preferably has a thickness of 0.5 to 10 mm and is preferably contacted to the photoreceptor with an angle of 10° to 45° to the tangential line at the contacting line of the photoreceptor drum 1 in the counter direction to the rotating direction of the drum.

In the image-forming method and image-forming apparatus of the present invention which is principally relating to the cleaning operation of the photoreceptor, as the optimum cleaning conditions for an organic photoreceptor, a rubber elastic cleaning blade having a impact resilience of 35 to 75% is used and the cleaning blade is contacted to the surface of the photoreceptor with a loading weight of 5 to 40 g/cm in the counter direction so that the static friction coefficient of the surface of the photoreceptor to the cleaning member is to be 1.0. As a result of that, insufficient cleaning caused by turning over of the cleaning blade can be prevented and a sufficient cleaning is attained with a little damage by wearing off of the surface of photoreceptor. However, foreign substance adhered on the surface of the photoreceptor, such as scattered toner, metal powder or paper powder, is hardly removed because the static friction coefficient is made lower.

The above problem is become remarkable when the electrostatic latent image is developed by a toner which contains a relapsing agent having a large number average domain diameter. The releasing agent having a large number average domain diameter tends to easily release to the toner. The releasing agent released from the toner is adhered on the surface of the photoreceptor and forms a filming layer.

The foreign substances adhere on the filming layer and cause image defects such as black spots, white spots and black streaks. Further, the cleaning effect of the blade cleaning member is occasionally lowered when the filming layer of the releasing agent is formed since the static friction coefficient is excessively lowered, for example, by 0.01 or less.

Accordingly, in the present invention, a development process using a toner containing a releasing agent having a number average domain diameter of 0.01 to 1.1 μm is applied in combination with the above-mentioned cleaning condition using the cleaning member to attain a desired sufficient cleaning. As a result of that, a high quality image can be obtained when the image formation is repeated for a prolonged term without lowering in the image quality and formation of image defect caused by fatigue and degradation of the photoreceptor.

EXAMPLES

<Preparation of Photoreceptor 1>

Thirty grams of polyamide resin CM-8000 (Torey Co., Ltd.) was put into a mixture solvent composed of 900 ml of methanol and 100 ml of 1-butanol, and was dissolved by heating at 50° C. After cooling by a room temperature, the solution was coated on an aluminum drum of an external diameter of 80 mm and a length of 355.5 mm by an immersion coating method to form an interlayer of a thickness of 0.5 μm.

Then 5 g of polyvinylbutyral resin Elex BX-1 (Sekisui Kagaku Co., Ltd.) was dissolved in 1000 ml of methyl ethyl ketone (MEK), and 10 g of the following CGM was further mixed and dispersed in the solution by a sand mill for 20 hours. Thus obtained dispersion was coated on the interlayer by an immersion coating method to form a CGL of a thickness of 0.5 μm.

Chemical structure of CGM:

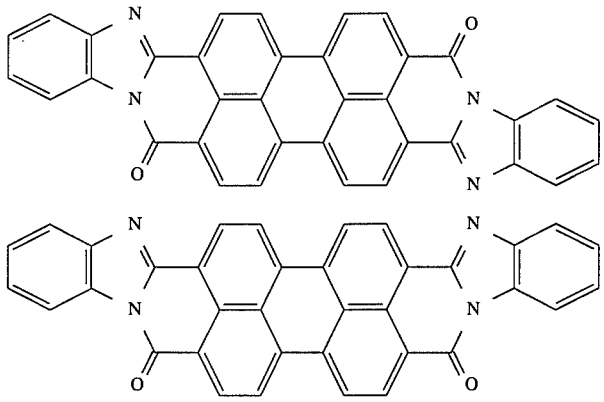

Next, 150 g of the following CTM and polycarbonate resin of the exemplified compound B-1 were dissolved in 1000 ml of dichloromethane. Then, 20 g of fine particles of fluororesin Lubron L-2 manufactured by Daikin Kogyo was added into the solution and was dispersed for 20 minutes in a tank to which ultrasonic vibration was applied. Thus obtained dispersion was coated on the above-mentioned by an immersion coating method to form a CTL of a thickness of 20 μm. The coated layers were dried at last for 1 hour at 100° C. Thus, Photoreceptor 1 was prepared, which has the interlayer, CGL and CTL laminated in this order from the substrate.

Chemical structure of CTM:

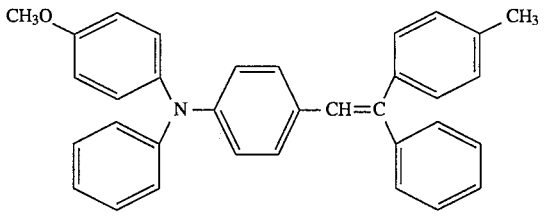

<Preparation of Photoreceptor 2>

Photoreceptor 2 was prepared in the same manner as in Photoreceptor 1 except that 150 g of exemplified compound B-2 was used in place of exemplified compound B-1 as the binder of the CTL.

<Preparation of Photoreceptor 3>

Photoreceptor 3 was prepared in the same manner as in Photoreceptor 1 except that 150 g of exemplified compound B-2 was used in place of exemplified compound B-1 as the binder of the CTL.

<Preparation of Photoreceptor 4>

Photoreceptor 4 was prepared in the same manner as in Photoreceptor 1 except that the fine particles of fluororesin were omitted.

<Preparation of Photoreceptor 5>

Photoreceptor 5 was prepared in the same manner as in Photoreceptor 1 except that the fine particles of resin were replaced by 50 g of Tospal 120 manufactured by Toshiba Silicone Co., Ltd..

<Preparation of Photoreceptor 6>

Photoreceptor 6 was prepared in the same manner as in Photoreceptor 1 except that the fine particles of resin were replaced by 20 g of Tospal 130 manufactured by Toshiba Silicone Co., Ltd..

<Preparation of Photoreceptor 7>

Photoreceptor 7 was prepared in the same manner as in Photoreceptor 1 except that the fine particles of resin were replaced by 20 g of Tospal 145 manufactured by Toshiba Silicone Co., Ltd..

<Preparation of two-component Developers 1 to 6>

Binder resin: Styrene-acryl resin (Styrene/methyl methacrylate/butyl acrylate copolymer in a ratio of 75:15:10, Mw/Mn=20) 100 p.b.w.

Colorant: Carbon black 10 p.b.w.

Releasing agent: Low molecular weight polypropylene (Mn=2500) 3 p.b.w.

(p.b.w.: Parts by weight)

The above components were mixed by a Henschel mixer, MF-10B manufactured by Mitsui-Miike Kakouki Co., Ltd., for 3 minutes with a circumference speed of mixing blade of 40 m/sec. The mixture was molten and kneaded by a kneader PCM-30 manufactured by Ikegai Tekkou Co., Ltd. under the following conditions. The kneading conditions were changed as the followings to prepare six kinds of toner particles each having the number average domain diameter of releasing agent of 0.07, 0.15, 0.31, 0.85, 1.05 and 1.21 μm, respectively. The rotating speed of the kneader was 150 r.p.m. for all samples.

| No. | Domain diameter (μm) | Temperature at kneading zone (°C.) | Supplying amount of mixture (g/min.) |
|---|---|---|---|
| 1 | 0.07 | 85 | 120 |
| 2 | 0.15 | 95 | 120 |
| 3 | 0.31 | 120 | 120 |
| 4 | 0.85 | 170 | 110 |
| 5 | 1.05 | 200 | 100 |
| 6 | 1.21 | 220 | 80 |

The kneaded samples were each crushed by a jet type crusher IDS-3 manufactured by Nihon Neumatic Co., Ltd. with a crushing pressure of 5 kg/cm$^2$, and classified by a classifying machine Microflex 132 MP manufactured by Alpine Co., Ltd..

The volume average diameter of each kind of toner particles were all 8.5 μm. Further, 0.4 parts by weight of hydrophobic silica Aerogil 972 manufactured by Nihon Aerogil Co., Ltd. was added to each kind of the colored toner particles to prepared 6 kinds of toner, each referred to Toners No. 1 to No. 6.

Four parts by weight of each of the above toners was mixed with 95 parts by weight of a carrier to prepare two-component Developers 1 to 6. The carrier was composed of ferrite particles having a volume average diameter of 80 μm, which were coated with a fluororesin composed of a copolymer of 2,2,2-trifluoroethyl methacrylate and styrene.

EXAMPLE 1

A modified copying machine U-BIX 4155 manufactured by Konica Corporation was prepared, in which the above Photoreceptor 1 and a urethane rubber cleaning blade made from urethane rubber No. 238679 manufactured by Hokusin Kogyo Co., Ltd. were installed. The cleaning blade was contacted to the surface of the photoreceptor in the counter direction with an angle of 20° and a loading weight of 18 g/cm. Using this machine, 50,000 times of copying operation was continuously carried out under an ordinary temperature and moisture. As the original image to be copied, a test pattern was used, which had a size of 257 mm×364 mm and included portions of white background, halftone image and solid black image, and the area of the image occupied 10% of the whole area of the test pattern. The image quality of the copies thus obtains was evaluated visually. Further, formation of turning over of the cleaning blade and wearing off of the photoconductive layer in the course of 50,000 times of copying were determined. Results of the above evaluations are shown in Table 1.

The worn off amount of the photoconductive layer was shown by the difference of the thickness of the layer before and after the 50,000 times continuous copying operation. The thickness of the photoconductive layer was an average value of those measured at ten points optionally selected on the layer by a contact or non-contact type layer thickness meter.

EXAMPLES 2 TO 13 AND COMPARATIVE EXAMPLES 1 TO 7

Examples 2 to 13 and Comparative Examples 1 to 7 were carried out in the same manner as in Example 1 except that the kind of photoreceptor, cleaning blade and developer, and the loading weight applied to the cleaning blade were changed as shown in Table 1. The quality of copied image, formation of turning over of the cleaning blade and the worn off amount of the photoconductive layer were evaluated. The results of the evaluation are listed in Table 1.

TABLE 1

| Example No. | Photoreceptor No. | Cleaning Blade: Material of blade | Resilience elasticity (%) | Static frict. coefficient | Loading weight (g/cm) |
|---|---|---|---|---|---|
| Ex- 1 | 1 | 238678 | 52 | 0.5 | 25 |
| Ex- 2 | 1 | 238678 | 52 | 0.5 | 25 |
| Ex- 3 | 1 | 238678 | 52 | 0.5 | 25 |
| Ex- 4 | 1 | 238678 | 52 | 0.5 | 25 |
| Ex- 5 | 3 | 238678 | 52 | 0.1 | 25 |
| Ex- 6 | 4 | 238678 | 52 | 0.9 | 25 |
| Ex- 7 | 2 | 238678 | 52 | 0.4 | 25 |
| Ex- 8 | 5 | 238678 | 52 | 0.7 | 25 |
| Ex- 9 | 6 | 238678 | 52 | 1.0 | 25 |
| Ex-10 | 3 | 231780 | 38 | 0.1 | 25 |
| Ex-11 | 3 | 238700 | 72 | 0.1 | 25 |
| Ex-12 | 1 | 238678 | 52 | 0.5 | 8 |
| Ex-13 | 1 | 238678 | 52 | 0.5 | 35 |
| CEx-1 | 7 | 238678 | 52 | 1.2 | 25 |
| CEx-2 | 1 | 238678 | 52 | 0.5 | 25 |
| CEx-3 | 1 | 238678 | 52 | 0.5 | 25 |
| CEx-4 | 1 | 238678 | 52 | 0.5 | 3 |
| CEx-5 | 1 | 238678 | 52 | 0.5 | 45 |
| CEx-6 | 1 | 233730 | 31 | 0.5 | 25 |
| CEx-7 | 1 | Sample | 77 | 0.5 | 25 |

| Example No. | Developer No. (Number average of domain diameter*) (μm) | Worn off thickness of photoreceptor (μm) | Turnin over of cleaning blade | Image quality |
|---|---|---|---|---|
| Ex- 1 | No. 2 (0.15) | 0.16 | None | Good |
| Ex- 2 | No. 3 (0.31) | 0.16 | None | Good |
| Ex- 3 | No. 4 (0.85) | 0.16 | None | Good |
| Ex- 4 | No. 5 (1.05) | 0.16 | None | Good |
| Ex- 5 | No. 3 (0.31) | 0.12 | None | Good |
| Ex- 6 | No. 3 (0.31) | 0.20 | None | Good |
| Ex- 7 | No. 3 (0.31) | 0.14 | None | Good |
| Ex- 8 | No. 3 (0.31) | 0.19 | None | Good |
| Ex- 9 | No. 3 (0.31) | 0.22 | None | Good |
| Ex-10 | No. 3 (0.31) | 0.12 | None | Good |
| Ex-11 | No. 3 (0.31) | 0.12 | None | Good |
| Ex-12 | No. 4 (0.85) | 0.12 | None | Good |
| Ex-13 | No. 4 (0.85) | 0.24 | None | Good |
| CEx-1 | No. 3 (0.31) | 0.26 | Formed | Black-stream |
| CEx-2 | No. 1 (0.07) | 0.16 | None | Off-set Contamination |
| CEx-3 | No. 6 (1.21) | 0.24 | Formed | Black streak & black spots |
| CEx-4 | No. 4 (0.85) | 0.14 | None | Insufficient cleaning & fogging on background |
| CEx-5 | No. 4 (0.85) | 0.35 | None | Lowered maximum density |
| CEx-6 | No. 3 (0.31) | 0.16 | Formed | Black streak |
| CEx-7 | No. 3 (0.31) | 0.33 | None | Lowered maximum density |

In the above tables, Ex and CEx are each Example and Comparative example, respectively.

An excellent image without insufficient cleaning caused by turning off of the cleaning blade, damage and wearing off at the surface of photoreceptor and degradation in electrophotographic properties of the photoreceptor and formation of image defects such as black- and white-spots and black-streaks in the course of repeated image formation using an organic photoreceptor can be obtained by the image-forming method and the image-forming apparatus of the invention.

What is claimed is:

1. An electrophotographic image-forming method comprising the steps of forming an electrostatic latent image on a rotating electrophotographic photoreceptor having an organic photoconductive layer, developing said electrostatic latent image with a toner comprising toner particles which contain a releasing agent existing in said toner particle in a form of insular domain having a number average diameter of 0.1 μm to 1.1 μm to form a toner image, transferring said toner image to an image receiving member, and cleaning a surface of said photoreceptor after the transferring step by a cleaning member having a rubber elastic cleaning blade having an impact resilience of 35 to 75% which is contacted to the surface of the photoreceptor in a direction counter to the rotating direction of the photoreceptor with a pressure of 5 to 40 g/cm, and a coefficient of static friction between said cleaning blade and said surface of the photoreceptor is not more than 1.0.

2. The image-forming method of claim 1, wherein the coefficient of static friction between said cleaning blade and the surface of the photoreceptor is within the range of from 0.01 to 1.0.

3. The image-forming method of claim 1, wherein said cleaning blade is made from urethane rubber.

* * * * *